United States Patent [19]

Cengel et al.

[11] Patent Number: 4,940,552

[45] Date of Patent: Jul. 10, 1990

[54] PASSIVATION OF POLYAMINE DISPERSANTS TOWARD FLUOROHYDROCARBON COMPOSITIONS

[75] Inventors: John A. Cengel, Wheaton; Peter G. Pappas, Downers Grove, both of Ill.

[73] Assignee: Amoco Corporation, Chicago, Ill.

[21] Appl. No.: 373,683

[22] Filed: Apr. 30, 1982

Related U.S. Application Data

[63] Continuation-in-part of Ser. No. 246,008, Mar. 20, 1981, abandoned.

[51] Int. Cl.[5] ..... C10M 1/36

[52] U.S. Cl. ..... 252/51.5 A; 540/356; 548/545; 548/546; 548/547; 562/561; 562/565

[58] Field of Search ..... 252/51.5 A; 548/545, 548/546, 547; 562/561, 565; 540/356

[56] References Cited

U.S. PATENT DOCUMENTS

| | | | |
|---|---|---|---|
| 3,219,666 | 11/1965 | Norman et al. | 252/51.5 A X |
| 3,442,808 | 5/1969 | Traise et al. | 252/51.5 A X |
| 3,452,002 | 6/1969 | Brasch | 252/51.5 A X |
| 4,142,980 | 3/1979 | Karll et al. | 252/51.5 A |
| 4,170,562 | 10/1979 | West | 252/51.5 A |
| 4,199,462 | 4/1980 | Soula et al. | 252/51.5 A |
| 4,364,846 | 12/1982 | Kaufman | 562/561 X |
| 4,433,977 | 2/1984 | Carrier et al. | 562/561 X |
| 4,479,888 | 10/1984 | Koch et al. | 252/51.5 A X |
| 4,505,835 | 3/1985 | Sung et al. | 562/561 X |
| 4,584,117 | 4/1986 | Wollenberg | 252/51.5 A |
| 4,647,390 | 3/1987 | Buckley et al. | 252/51.5 A |

*Primary Examiner*—Paul F. Shaver

*Attorney, Agent, or Firm*—Matthew R. Hooper; William M. Magidson; Ralph C. Medhurst

[57] ABSTRACT

Dispersants containing basic amine groups are passivated toward fluorohydrocarbon compositions by reaction with a passivating amount of a dicarboxylic acid or anhydride.

7 Claims, No Drawings

PASSIVATION OF POLYAMINE DISPERSANTS TOWARD FLUOROHYDROCARBON COMPOSITIONS

CROSS-REFERENCE TO RELATED APPLICATIONS

This application is a continuation-in-part of application Ser. No. 246,008, filed Mar. 20, 1981, now abandoned.

BACKGROUND OF THE INVENTION

1. Field of the Invention

This invention relates to dispersant additives for lubricating oils. More particularly, the invention relates to the modification of conventional polyamine dispersants so that they can be used in internal combustion engines which contain fluorohydrocarbon-type engine seals without causing discoloration, decomposition, and mechanical or dimensional degradation of the seals.

2. Description of the Prior Art

The deterioration of a lubricating oil during service in an internal combustion engine results in the formation of varnish-like deposits and the generation of products which agglomerate to form sludge-like materials. Since this varnish and sludge interferes with efficient engine operation, it has become conventional practice to incorporate into lubricating oils certain chemical compositions which have the ability to reduce or prevent the formation of sludge and the deposition of varnish. These additives are broadly referred to as dispersants.

Among the many types of dispersants which have been developed, polyamine dispersants are highly effective and are widely used. For the purpose of this application, a polyamine dispersant is an oil-soluble composition which contains at least one basic amine group and is effective as a dispersant additive for lubricating oils.

Fluorohydrocarbon elastomers are increasingly being used in fabricating the flexible seals which are used in internal combustion engines. These seals are used, for example, to prevent leakage of lubricants at the point where moving parts, such as a crankshaft, leave the engine. Any substantial leakage of lubricant from the engine is obviously undesirable.

Unfortunately, engine seals prepared from fluorohydrocarbon compositions are subject to discoloration and mechanical deterioration when used in engines which are lubricated with lubricating oils containing polyamine dispersants. The polyamine dispersants interact with the fluorohydrocarbon compositions of the seals, causing the seals to swell and to lose mechanical and dimensional integrity. The rate of attack of the fluorohydrocarbon compositions by a polyamine dispersant appears to be directly proportional to the concentration of polyamine dispersant and to the operating temperature of the engine. As the engine operating temperature rises, the rate of decomposition of the seal rises proportionately. As interaction of the dispersant with the seal continues, the mechanical strength and dimensional integrity of the seal increasingly deteriorates until the seal fails to prevent the leakage of lubricant from the engine.

U.S. Pat. No. 3,442,808 (Traise et al.) is directed to the preparation of a dispersant by reacting a polyalkenyl succinic anhydride with a Mannich condensation product prepared by condensing an alkyl-substituted phenol with formaldehyde and a polyalkylene polyamine. The polyalkenyl succinic anhydride is derived from the reaction of maleic anhydride with a polymer of a monoolefin having three or four carbon atoms wherein the polymer has a viscosity at 210° F. (99° C.) of about 50 to about 10,000 Saybolt Universal Seconds. It is disclosed that reaction of the Mannich product with the polyalkenyl succinic anhydride results in a dispersant having improved oil solubility properties. However, this patent fails to suggest the reaction of a Mannich product with a low molecular weight substituted succinic anhydride for any purpose.

U.S. Pat. Nos. 3,639,242 (LeSuer) and 3,708,522 (LeSuer) are directed to the post-treatment of high molecular weight, oil-soluble, mono- and polycarboxylic acid esters with acylating agents to provide compositions which are useful as dispersants in lubricants and fuels. The esters are derived from aliphatic polyhydric alcohols and, among many others, amino alcohols are disclosed as being suitable. In addition, the acylating agents used for the post-treatment process are $C_1$–$C_{30}$ mono- or polycarboxylic acids, their halides, anhydrides or mixtures thereof. However, these patents fail to either teach or suggest that polyamine dispersants cause the deterioration of fluorohydrocarbon compositions and fail to teach or suggest that such dispersants can be passivated toward fluorohydrocarbon compositions by reaction with specific amounts of a dicarboxylic acid or anhydride. Consequently, these patents offer no guidance with respect to the specific selection of polyamine dispersants and adjustment of the concentration of dicarboxylic acid or anhydride to achieve passivation of these dispersants toward fluorohydrocarbon compositions.

SUMMARY OF THE INVENTION

The present invention is directed to the discovery that polyamine dispersants can be passivated toward fluorohydrocarbon compositions by reacting the polyamine dispersant with a passivating amount of a dicarboxylic acid or anhydride. We have found that the reaction product of the polyamine dispersant and the dicarboxylic acid or anhydride is effective in maintaining a high level of dispersancy in lubricating oils without causing deterioration of fluorohydrocarbon seals.

One embodiment of the invention is a composition comprising the reaction product of a polyamine dispersant with a reactant selected from the group consisting of dicarboxylic acids of the formula:

$$HO_2C\text{-}A\text{-}CO_2H$$

and acid anhydrides of the formula:

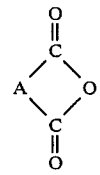

wherein A is a divalent hydrocarbyl group of from 1 to 10 carbon atoms with the proviso that A can have up to 2 substituents selected from the group consisting of chloro, nitro, carboxyl and cyano; wherein said polyamine dispersant contains at least one primary or secondary amine group and is effective as a dispersant additive for lubricating oils; and wherein the amount of said reactant is effective to reduce the reactivity of said polyamine dispersant toward fluorohydrocarbon compositions.

Another embodiment of the invention is a composition comprising the reaction product of a polyamine dispersant with a reactant selected from the group consisting of dicarboxylic acids of the formula:

$$HO_2C\text{-}A\text{-}CO_2H$$

wherein A is a divalent hydrocarbyl group of from 1 to 10 carbon atoms with the proviso that A can have up to 2 substituents selected from the group consisting of chloro, nitro, carboxyl and cyano; wherein said polyamine dispersant contains at least one basic amine group and is effective as a dispersant additive for lubricating oils; and wherein the amount of said reactant is effective to reduce the reactivity of said polyamine dispersant toward fluorohydrocarbon compositions.

An object of this invention is to provide a polyamine dispersant which imparts high levels of dispersancy to crankcase lubricants without causing the deterioration of fluorohydrocarbon engine seals.

Another object of this invention is to passivate polyamine dispersants toward fluorohydrocarbon compositions.

A further object of this invention is to provide a high-quality dispersant additive for lubricating oils which has substantially no effect on fluorohydrocarbon engine seals.

A still further object of this invention is to prevent the leakage of lubricant from the crankcase of an internal combustion engine having fluorohydrocarbon seals.

DETAILED DESCRIPTION OF THE INVENTION

The improved polyamine dispersants of this invention are prepared by reacting a polyamine dispersant with an amount of dicarboxylic acid or anhydride which is effective to reduce the reactivity of the polyamine dispersant toward fluorohydrocarbon compositions.

Suitable dicarboxylic acids for use in the practice of this invention include those of the general formula:

$$HO_2C\text{-}A\text{-}CO_2H$$

wherein A is a divalent hydrocarbyl group of from 1 to 10 carbon atoms with the proviso that A can have up to 2 non-hydrocarbon substituents selected from the group consisting of chloro, nitro, carboxyl and cyano.

Suitable dicarboxylic acid anhydrides for use in the practice of this invention include the anhydrides of the above defined acids which have the general formula:

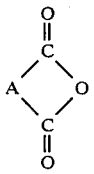

wherein A has the same meaning as set forth above.

As used herein, a divalent hydrocarbyl group is a divalent organic group which is composed of hydrogen and carbon and, for example, can be straight chain, branched, or cyclic in character.

Specific examples of dicarboxylic acids and anhydrides which are suitable for use in this invention include, but are not limited to, maleic anhydride, maleic acid, succinic acid, succinic anhydride, fumaric acid, itaconic acid, chloromaleic anhydride, citraconic acid, citraconic anhydride, phthalic acid, phthalic anhydride, malonic acid, glutaconic acid, aconitic acid, adipic acid and sebacic acid. However, maleic anhydride is preferred for reasons of economy, availability, and ease of reaction.

Oil soluble polyamine dispersants containing at least one primary or secondary amine group can be passivated toward fluorohydrocarbon compositions in accordance with this invention by reaction with either dicarboxylic acids or anhydrides. That is to say, preferred polyamine dispersants for use in the practice of this invention contain at least one amine group wherein the nitrogen atom is bonded to either one or two hydrogen atoms. Polyamine dispersants which contain only tertiary amine groups and are free of both primary and secondary amine groups can also be passivated toward fluorohydrocarbon compositions by reaction with an effective amount of a dicarboxylic acid. However, these polyamine dispersants which are free of both primary and secondary amine groups are not preferred and cannot ordinarily be passivated by reaction with dicarboxylic acid anhydrides since the anhydrides do not react with the tertiary amine groups.

The polyamine dispersants which can be used in the practice of this invention preferably contain an oil-solubilizing group containing at least about 40 carbon atoms directly or indirectly bonded to a polar polyamine group. The dispersant can contain more than one of such oil-solubilizing groups per molecule as will be apparent from the description hereinafter. Many dispersants of this type are known in the art and are described in various patents. Any of such dispersants are suitable for use in the practice of this invention. The following are illustrative:

(1) Reaction products of an acylating agent such as a monocarboxylic acid, dicarboxylic acid, polycarboxylic acid, or derivatives thereof with compounds which contain amine groups. These products, hereinafter referred to as carboxylic polyamine dispersants, are described in many patents, including British patent specification No. 1,306,529 and the following U.S. Pat. Nos. which are incorporated by reference herein:

| | | |
|---|---|---|
| 3,163,603 | 3,341,542 | 3,467,668 |
| 3,184,474 | 3,346,493 | 3,522,179 |
| 3,215,707 | 3,381,022 | 3,541,012 |
| 3,219,666 | 3,399,141 | 3,542,678 |
| 3,271,310 | 3,415,750 | 3,574,101 |
| 3,272,746 | 3,433,744 | 3,576,743 |
| 3,281,357 | 3,444,170 | 3,630,904 |
| 3,306,908 | 3,448,048 | 3,632,510 |
| 3,311,558 | 3,448,049 | 3,632,511 |
| 3,316,177 | 3,451,933 | 3,697,428 |
| 3,340,281 | 3,454,607 | 3,725,441 |
| | | Re 26,433 |

(2) Reaction products of aliphatic or alicyclic halides containing at least about 40 carbon atoms with amines, preferably polyalkylene polyamines, which are hereinafter characterized as alkyl polyamine dispersants. Examples of these materials are described in the following U.S. Pat. Nos. which are incorporated by reference herein:

| | |
|---|---|
| 3,275,554 | 3,454,555 |
| 3,438,757 | 3,565,804 |

(3) Reaction products of an alkyl phenol, wherein the alkyl group is oil soluble, or an oxidized olefinic polymer with aliphatic aldehydes containing from 1 to 7 carbon atoms (especially formaldehyde and derivatives thereof) and amines (especially polyalkylene polyamines), which are hereinafter characterized as Mannich polyamine dispersants. Examples of these materials are described in the following U.S. Pat. Nos. which are incorporated by reference herein:

| | | |
|---|---|---|
| 2,459,112 | 3,448,047 | 3,634,515 |
| 2,962,442 | 3,454,497 | 3,649,229 |
| 2,984,550 | 3,459,661 | 3,697,574 |
| 3,036,003 | 3,493,520 | 3,725,277 |
| 3,166,516 | 3,539,633 | 3,725,480 |
| 3,236,770 | 3,558,743 | 3,726,882 |
| 3,368,972 | 3,586,629 | 3,872,019 |
| 3,413,347 | 3,591,598 | 3,980,569 |
| 3,442,808 | 3,600,372 | 4,011,380 |

(4) Polymers containing basic amine groups and oil solubilizing groups (for example, pendant alkyl groups having at least about 8 carbon atoms), which are referred to hereinafter as polymeric polyamine dispersants. Such materials include, but are not limited to, interpolymers of decyl methacrylate, vinyl decyl ether or a relatively high molecular weight olefin with aminoalkyl acrylates and aminoalkyl acrylamides. Examples of such materials are set forth in the following U.S. Pat. Nos. which are incorporated by reference herein:

| | |
|---|---|
| 3,329,658 | 3,666,730 |
| 3,449,250 | 3,687,849 |
| 3,519,565 | 3,702,300 |

(5) Products obtained by treating the above described carboxylic polyamine, alkyl polyamine, Mannich polyamine, and polymeric polyamine dispersants with reagents such as urea, thiourea, carbon disulfide, aldehydes, ketones, carboxylic acids, polyalkenyl succinic anhydrides, nitriles, epoxides, boron compounds, phosphorous compounds and the like. Such products are referred to hereinafter as treated polyamine dispersants. Exemplary materials of this type are described in German Offenlegungsschrift No. 2,551,256 and in the following U.S. Pat. Nos. which are incorporated herein by reference:

| | | | |
|---|---|---|---|
| 3,036,003 | 3,282,955 | 3,493,520 | 3,658,836 |
| 3,087,936 | 3,312,619 | 3,502,677 | 3,697,574 |
| 3,200,107 | 3,366,569 | 3,513,093 | 3,702,757 |
| 3,216,936 | 3,367,943 | 3,539,633 | 3,703,536 |
| 3,254,025 | 3,373,111 | 3,573,010 | 3,704,308 |
| 3,256,185 | 3,442,808 | 3,591,598 | |
| 3,278,550 | 3,455,831 | 3,600,372 | |
| 3,281,428 | 3,455,832 | 3,649,659 | |

The Mannich polyamine dispersants are those disclosed, for example, in the above mentioned U.S. Pat. No. 3,368,972, which also describes convenient methods for their preparation. The polyamine group therein is derived from polyamine compounds characterized by a radical of the structure —NH— wherein the two remaining valences of the nitrogen are satisfied by hydrogen, amino, or organic radicals bonded to said nitrogen atom. These compounds include aliphatic, aromatic, heterocyclic and carbocyclic polyamines. The source of the oil soluble hydrocarbyl group in the Mannich polyamine dispersant is a hydrocarbylsubstituted hydroxy aromatic compound comprising the reaction product of a hydroxy aromatic compound, according to well known procedures, with a hydrocarbyl donating agent or hydrocarbon source. The hydrocarbyl substituent provides substantial oil solubility to the hydroxy aromatic compound and, preferably, is substantially aliphatic in character. Commonly, the hydrocarbyl substituent is derived from a polyolefin having at least about 40 carbon atoms. The hydrocarbon source should be substantially free from pendant groups which render the hydrocarbyl group oil insoluble. Examples of acceptable substituent groups are halide, hydroxy, ether, carboxy, ester, amide, nitro and cyano. However, these substituent groups preferably comprise no more than about 10 weight percent of the hydrocarbon source.

The preferred hydrocarbon sources for preparation of the Mannich polyamine dispersants are those derived from substantially saturated petroleum fractions and olefin polymers, preferably polymers of mono-olefins having from 2 to about 30 carbon atoms. The hydrocarbon source can be derived, for example, from polymers of olefins such as ethylene, propene, 1-butene, isobutene, 1-octene, 1-methylcyclohexene, 2-butene and 3-pentene. Also useful are copolymers of such olefins with other polymerizable olefinic substances such as styrene. In general, these copolymers should contain at least 80 percent and preferably about 95 percent, on a weight basis, of units derived from the aliphatic monoolefins to preserve oil solubility. The hydrocarbon source generally contains at least about 40 and preferably at least about 50 carbon atoms to provide substantial oil solubility to the dispersant. The olefin polymers having a number average molecular weight between about 600 and 5,000 are preferred for reasons of easy reactivity and low cost. However, polymers of higher molecular weight can also be used. Especially suitable hydrocarbon sources are isobutylene polymers.

The Mannich polyamine dispersants are generally prepared by reacting a hydrocarbyl-substituted hydroxy aromatic compound with an aldehyde and a polyamine. Typically, the substituted hydroxy aromatic compound is contacted with from about 0.1 to about 10 moles of polyamine and about 0.1 to about 10 moles of aldehyde per mole of substituted hydroxy aromatic compound. The reactants are mixed and heated to a temperature above about 80° C. to initiate the reaction. Preferably, the reaction is carried out at a temperature from about 100° to about 250° C. The resulting Mannich product has a predominantly benzylamine linkage between the aromatic compound and the polyamine. The reaction can be carried out in an inert diluent such as mineral oil, benzene, toluene, naphtha, ligroin, or other inert solvents to facilitate control of viscosity, temperature and reaction rate.

Polyamines are preferred for use in preparing the Mannich polyamine dispersants, and suitable polyamines include, but are not limited to, alkylene diamines and polyalkylene polyamines (and mixtures thereof) of the formula:

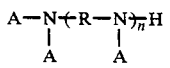

wherein n is an integer from 1 to about 10, R is a divalent hydrocarbyl group of from 1 to about 18 carbon atoms, and each A is independently selected from the group consisting of hydrogen and hydrocarbyl containing up to 30 carbon atoms which can be substituted with one or two hydroxyl groups. Preferably, n is an integer from 2 to 8, R is a lower alkylene group of from 1 to 10 carbon atoms, and each A is independently selected from the group consisting of hydrogen and monovalent aliphatic groups containing up to 10 carbon atoms which can be substituted with one or two hydroxyl groups. Most preferably, R is a lower alkylene group of from 2 to 6 carbon atoms and A is hydrogen.

Suitable polyamines for use in preparation of the Mannich polyamine dispersants include, but are not limited to, methylene polyamines, ethylene polyamines, butylene polyamines, propylene polyamines, pentylene polyamines, hexylene polyamines and heptylene polyamines. The higher homologs of such amines and related aminoalkyl-substituted piperazines are also included. Specific examples of such polyamines include ethylenediamine, triethylenetetramine, tris(2-aminoethyl)amine, propylenediamine, trimethylenediamine, hexamethylenediamine, decamethylenediamine, octamethylenediamine, di(heptamethylene)triamine, trimethylenediamine, pentaethylenehexamine, di(trimethylene)triamine, 2-heptyl-3-(2-aminopropyl)imidazoline, 1,3-bis(2-aminoethyl)imidazoline, 1-(2-aminopropyl)piperazine, 1,4-bis(2-aminoethyl)piperazine and 2-methyl1-(2-aminobutyl)piperazine. Higher homologs, obtained by condensing two or more of the above mentioned amines, are also useful, as are the polyoxyalkylene polyamines.

The polyalkylene polyamines, examples of which are set forth above, are especially useful in preparing the Mannich polyamine dispersants for reasons of cost and effectiveness. Such polyamines are described in detail under the heading "Diamines and Higher Amines" in Krik-Othmer, Encyclopedia of Chemical Technology, Second Edition, Vol. 7, pp. 22–39. They are prepared most conveniently by the reaction of an alkylene dichloride with ammonia or by reaction of an ethylene imine with a ring-opening reagent such as ammonia. These reactions result in the production of somewhat complex mixtures of polyalkylene polyamines which include cyclic condensation products such as piperazines. Because of their availability, these mixtures are particularly useful in preparing the Mannich polyamine dispersants. However, it will be appreciated that satisfactory dispersants can also be obtained by use of pure polyalkylene polyamines.

Alkylene diamines and polyalkylene polyamines having one or more hydroxyalkyl substituents on the nitrogen atoms are also useful in preparing the Mannich polyamine dispersants. These materials are typically obtained by reaction of the corresponding polyamine with an epoxide such as ethylene oxide or propylene oxide. Preferred hydroxyalkyl-substituted diamines and polyamines are those in which the hydroxyalkyl groups have less than about 10 carbon atoms. Examples of suitable hydroxyalkyl-substituted diamines and polyamines include, but are not limited to, N-(2hydroxyethyl)ethylenediamine, N,N'-bis(2-hydroxyethyl)ethylenediamine, mono(hydroxypropyl)diethylenetriamine, di(hydroxypropyl)tetraethylenepentamine and N-(3-hydroxybutyl)tetramethylenediamine. Higher homologs obtained by condensation of the above mentioned hydroxyalkyl-substituted diamines and polyamines through amine groups or through ether groups are also useful.

Any conventional formaldehyde yielding reagent is useful for the preparation of the Mannich polyamine dispersants. Examples of such formaldehyde yielding reagents are trioxane, paraformaldehyde, trioxymethylene, aqueous formalin and gaseous formaldehyde.

The carboxylic polyamine dispersants are those disclosed, for example, in the above mentioned U.S. Pat. Nos. 3,219,666 and 3,272,746, which also describe a large number of methods for their preparation. The polyamine group therein is derived from polyamine compounds characterized by a radical of the structure —NH— wherein the two remaining valences of nitrogen are satisfied by hydrogen, amino or organic radicals bonded to said nitrogen. These compounds include aliphatic, aromatic, heterocyclic and carbocyclic polyamines. Suitable polyamines for use in preparing the carboxylic polyamine dispersants are identical with those which are described above as being suitable for use in preparing the Mannich polyamine dispersants. However, preferred polyamines for use in preparing the carboxylic polyamine dispersants are free of hydroxyl groups.

The source of the acyl group in the carboxylic polyamine dispersants is an acylating agent comprising a carboxylic acid-producing compound containing a hydrocarbyl or substituted hydrocarbyl substituent which has at least about 40 and preferably at least about 50 carbon atoms. The terminology "carboxylic acid-producing compound" includes, but is not limited to carboxylic acids, anhydrides, acid halides, esters, amides, imides and amidines. However, the carboxylic acids and their anhydrides are preferred.

The carboxylic acid-producing compound is usually prepared by the reaction, according to well known procedures, of a relatively low molecular weight carboxylic acid or derivative thereof with a hydrocarbyl donating agent or hydrocarbon source containing at least about 40 and preferably at least about 50 carbon atoms. The hydrocarbon source is usually aliphatic and should be substantially saturated. More specifically, at least about 95% of the total number of carbon-to-carbon covalent linkages should be saturated. The hydrocarbon source should also be substantially free from pendant groups containing more than about six aliphatic carbon atoms. The hydrocabon source can be substituted, and examples of acceptable groups are halide, hydroxy, ether, keto, carboxyl, ester (especially lower carboalkoxy), amide, nitro, cyano, sulfoxide and sulfone. The substituents, if present, generally comprise no more than about 10 weight percent of the hydrocarbon source.

The preferred hydrocarbon sources for preparation of the carboxylic acid-producing compound are those derived from substantially saturated petroleum fractions and olefin polymers, particularly polymers of monoolefins having from 2 to about 30 carbon atoms. The hydrocarbon source can be derived, for example, from polymers of ethylene, propene, 1-butene, isobutene, 1-octene, 3-cyclohexyl-1-butene, 2-butene and 3-pentene. Also useful are copolymers of such olefins with other polymerizable olefinic substances such as styrene, chloroprene, isoprene, p-methylstyrene and piperylene. In general, these copolymers should contain at least about 80 percent and preferably at least about 95 percent, on a weight basis, of units derived from the aliphatic mono-olefins. Olefin polymers having a number average molecular weight between about 600 and about 5,000 (as determined by gel permeation chromatography) are preferred, although higher polymers having higher molecular weights, for example, from about 10,000 to about 100,000 or higher, can also be used. Especially suitable as hydrocarbon sources are isobutene polymers and chlorinated derivatives thereof.

Another suitable hydrocarbon source for preparation of the carboxylic acid-producing compound comprises saturated aliphatic hydrocarbons such as highly refined high molecular weight white oils or synthetic alkanes.

In many instances, the hydrocarbon source for use in preparing the carboxylic acid-producing compound should contain an activating polar group. This polar group can serve to facilitate reaction between the hydrocarbon source and a low molecular weight carboxylic acid or derivative when such a process is used to prepare the carboxylic acid-producing compound. Preferred polar groups are halogen, especially chlorine, but other suitable polar groups include sulfide, disulfide, nitro, mercapto, as well as ketone and aldehyde carbonyl groups.

Any one of a number of known reactions can be employed for the preparation of the carboxylic acid-producing compounds. Thus, an alcohol of the desired molecular weight can be oxidized with potassium permanganate, nitric acid or a similar oxidizing agent; a halogenated olefin polymer can be reacted with a ketene; an ester of an active hydrogen-containing acid, such as acetoacetic acid, can be converted to its sodium derivative and the sodium derivative reacted with a halogenated high molecular weight hydrocarbon such as brominated wax or brominated polyisobutene; a high molecular weight olefin can be ozonized; a methyl ketone of the desired molecular weight can be oxidized by means of the haloform reaction; an organometallic derivative of a halogenated hydrocarbon can be reacted with carbon dioxide; a halogenated hydrocarbon or olefin polymer can be converted to a nitrile, which is subsequently hydrolyzed. Preferably, an olefin polymer or its halogenated derivative is reacted with an unsaturated carboxylic acid or derivative thereof such as acrylic acid, methacrylic acid, maleic acid, maleic anhydride, fumaric acid, itaconic acid, itaconic anhydride, citraconic acid, citraconic anhydride, mesaconic acid, glutaconic acid, chloromaleic acid, aconitic acid, crotonic acid, methylcrotonic acid, sorbic acid, 3-hexenoic acid, 10-decenoic acid, 2-pentene-1,3,5-tricarboxylic acid, and the like, or a halogen-substituted carboxylic acid or derivative thereof.

The reaction of an olefin polymer or a halogenated derivative thereof with maleic acid or anhydride is particularly preferred for use in preparation of the carboxylic acid-producing compound. The resulting product is then a hydrocarbyl-substituted succinic acid, or anhydride. The reaction involves merely heating the two reactants at a temperature from about 100° to about 250° C. The substituted succinic acid or anhydride thus obtained, can, if desired, be converted to the corresponding acid halide by reaction with known halogenating agents such as phosphorus trichloride, phosphorus pentachloride or thionyl chloride.

For the formation of the carboxylic polyamine dispersant, the hydrocarbyl-substituted succinic acid or anhydride, or other carboxylic acid-producing compound and a polyamine, such as a polyalkylene polyamine, are heated to a temperature above about 80° C., and preferably from about 100° to about 250° C. The polyamine combines with the carboxylic acid-producing compound through the predominant formation of amide, imide and/or amidine linkages (containing acyl or acylamidoyl groups). In some instances, the polyamine can be combined with the carboxylic acid-producing compound at a temperature below about 80° C. through predominant amine salt formation (containing acyloxy groups). The use of a diluent such as mineral oil, benzene, toluene, naphtha or the like is often desirable to facilitate control of the reaction temperature.

In preparing the carboxylic polyamine dispersant, the relative proportions of the carboxylic acid-producing compound and the polyamine starting materials are such that at least about a stoichiometrically equivalent amount of polyamine is used for each equivalent of carboxylic acid-producing compound. In this regard, it will be appreciated that the equivalent weight of the polyamine starting material is based on the number of amine groups therein, and the equivalent weight of the carboxylic acid-producing compound is based on the number of acidic or potentially acidic groups. By way of example, the equivalent weight of a hydrocarbyl-substituted succinic acid or anhydride is one-half of its molecular weight.

In an alternative method for producing the carboxylic polyamine dispersant, a polyamine, such as a polyalkylene polyamine, is reacted with a low molecular weight, unsaturated or halogen-substituted acylating agent such as a carboxylic acid or anhydride. The resulting intermediate is then reacted with the hydrocarbon source, as previously described, to give the desired dispersant.

In somewhat greater detail, polyamine dispersants can be passivated toward fluorohydrocarbon compositions in accordance with this invention by reaction with a dicarboxylic acid or anhydride at a temperature from about 20° to about 300° C. and preferably from about 80° to about 250° C., either in the presence or absence of a solvent. In addition, the polyamine dispersant is contacted with an amount of dicarboxylic acid or anhydride which is effective to reduce the basicity of the dispersant and, thereby, reduce the reactivity of the dispersant toward fluorohydrocarbon compositions. Desirably, the amount of dicarboxylic acid or anhydride is effective to reduce the total base number (TBN) of the polyamine dispersant by at least about 10 percent, preferably by at least about 20 percent, and most preferably by at least about 50 percent. The greater the reduction of the TBN, the greater the passivation of the polyamine dispersant toward fluorohydrocarbon compositions.

The total base number or TBN is defined as the number of milligrams of potassium hydroxide which are equivalent to the amount of acid required to neutralize the alkaline material present in one gram of a composition. Consequently, the magnitude of the total base number serves to indicate the ability of a given composition to neutralize acids. A standard procedure for measuring TBN is set forth in American Society for Testing and Materials (ASTM) test D-2896.

In a specific embodiment, the amount of maleic anhydride which is sufficient to reduce the reactivity of a polyamine dispersant toward fluorohydrocarbon compositions can comprise from about 0.1 to about 10, preferably about 0.5 to about 5.0, and more preferably about 1.0 to about 3.0 moles for each mole of amine group nitrogen-hydrogen bonds in the polyamine dispersant. Frequently, the polyamine dispersant will be reacted with from about 0.05 to about 10, and preferably about 0.1 to about 5.0 weight percent of maleic anhydride based on the dispersant.

While it is clear that complete reaction of each basic amine group in a polyamine dispersant is not necessary for substantial passivation of the dispersant toward fluorohydrocarbon compositions, the precise amount of dicarboxylic acid or anhydride which is required will depend on the specific polyamine dispersant. Accordingly, it will be appreciated that those skilled in the art can vary the amount of dicarboxylic acid or anhydride to effect the desired degree of passivation of a specific polyamine dispersant toward fluorohydrocarbon compositions.

The products of this invention can be prepared either in continuous or batch equipment. In a batch process, a suitable amount of each reactant is charged to a reaction vessel wherein the reaction is carried to completion at appropriate temperatures and pressures. In a continuous process, suitable amounts of each reactant are continuously charged to one end of a reaction zone, wherein appropriate reaction conditions are maintained, and a product stream is continuously withdrawn from the other end of the reaction zone. The various possible sequences by which the polyamine dispersant can be combined with the dicarboxylic acid or anhydride appear to be equivalent in passivating the dispersant toward fluorohydrocarbon seals. We theorize that the dicarboxylic acid or anhydride reacts with basic amine groups in the polyamine dispersant through amine salt formation or the generation of amide or imide groups. This reaction serves to reduce the basicity of the dispersant, but does not prevent the polar functional groups of the dispersant from suspending sludge and preventing deposits in internal combustion engines.

The polyamine dispersants which have been passivated toward fluorohydrocarbon compositions in accordance with this invention can be used in lubricating oil compositions at a concentration of about 0.1 to about 50 weight percent, and preferably about 0.5 to about 15 weight percent based on the total composition. A lubricating oil composition will typically comprise a major portion of a lubricating oil in combination with the passivated polyamine dispersant of this invention, wherein the amount of passivated dispersant is from about 0.5 to about 15 weight percent of the lubricating oil composition. Such a lubricating oil composition can be dissolved in gasoline for use in two-cycle engines.

Lubricating oils to which the passivated polyamine dispersants of this invention can be added include animal, vegetable, mineral, and synthetic oils. For example, castor oil, lard oil, and also solvent refined or acid refined mineral oils of the paraffinic, naphthenic or mixed paraffinic and naphthenic types are useful. Oils of lubricating viscosity derived from coal or shale are also useful. Suitable synthetic lubricating oils include hydrocarbon oils and halogen-substituted hydrocarbon oils such as polymerized and interpolymerized olefins and alkylated benzenes. Other suitable synthetic lubricating oils include esters of dicarboxylic acids such as phthalic acid, succinic acid, maleic acid, sebacic acid and azelaic acid with a variety of monohydroxy and polyhydroxy alcohols. Silicone based oils such as the polyalkyl and polyalkoxy siloxane and silicate oils can also be used.

The passivated polyamine dispersants of this invention can be used in combination with other conventional lubricating oil additives which include, but are not limited to, detergents, other dispersants, pour point depressants, antifoam agents, extreme pressure agents, rust-inhibiting agents, oxidation inhibitors, corrosion inhibitors, and various mixtures of these materials in various proportions.

The following examples are intended only to illustrate the invention and are not to be construed as imposing limitations on it.

EXAMPLE I

Into a 5 liter, three-neck reaction flask equipped with a heater, stirrer, and temperature controller was charged 2,961 grams of a Mannich polyamine dispersant comprising a reaction product of a polyisobutylene-substituted phenol having a molecular weight of about 1,600, formaldehyde, tetraethylenepentamine and oleic acid in a weight ratio of 25/1/1.3/0.1 respectively. The dispersant was stirred and heated to a temperature of 204° C., and 59.22 grams (0.6 mole) of maleic anhydride were added. The resulting mixture was maintained at 204° C., stirred and permitted to react for 1 hour.

EXAMPLE II

Example I was repeated except that the amount of maleic anhydride used was 88.83 grams (0.9 mole).

EXAMPLE III

Into a 3 liter, three-neck reaction flask equipped with a heater, stirrer, and temperature controller was charged 1,500 grams of a Mannich polyamine dispersant comprising the reaction product of a polyisobutylene-substituted phenol having a molecular weight of about 1,600, formaldehyde, tetraethylenepentamine and oleic acid in a weight ratio of 25/1/1.3/0.1 respectively. The dispersant was heated to a temperature of 160° C., and 30 grams (0.3 mole) of maleic anhydride were added with stirring. The resulting mixture was then maintained at 160° C. for 1 hour with stirring.

EXAMPLE IV

Example III was repeated except that the amount of maleic anhydride used was 45 grams (0.46 moles).

EXAMPLE V

Into a 1 liter, three-neck reaction flask equipped with a heater, stirrer, and temperature controller was charged 300 grams of a succinimide dispersant having a TBN of 53.8 and comprising the reaction product of a polyisobutylene-substituted succinic anhydride with a polyalkylene polyamine having both primary and secondary amine groups. The dispersant was heated to a temperature of 160° C., and 3 grams (0.03 moles) of maleic anhydride were added with stirring. The resulting mixture was then maintained at 160° C. with stirring for 1 hour to give a product having a TBN of 41.4.

EXAMPLE VI

Example V was repeated except that the amount of maleic anhydride was 6 grams (0.06 moles). The resulting product had a TBN of 35.1.

EXAMPLE VII

Example V was repeated except that the amount of maleic anhydride was 9 grams (0.09 moles). The resulting product had a TBN of 19.8.

EXAMPLE VIII

The passivation of polyamine dispersants toward fluorohydrocarbon compositions in accordance with this invention was evaluated in accordance with the standard procedures set forth in American Society for Testing and Materials (ASTM) tests D-471 and D-412. More specifically, the effect of various polyamine dispersants and passivated polyamine dispersants toward KACO FPM 75 604 fluorohydrocarbon elastomer was evaluated at 150° C. Two test oils, A and B, were employed, and, except for the control tests without any dispersant, oil A was a fully formulated motor oil containing 5.5 weight percent of the dispersant, and oil B was a fully formulated motor oil containing 5.0 weight percent of the dispersant. Oil A contained magnesium sulfonate, zinc dialkyl dithiophosphate, calcium phenate and calcium sulfonate additives in a combined amount of 3.8 weight percent. Oil B contained magnesium sulfonate, zinc dialkyl dithiophosphate, calcium phenate and calcium sulfonate additives in a combined amount of 3.6 weight percent. Except for the absence of dispersant, identical oils were used for the control experiments. The dispersants were used in the test oils at a commercially acceptable level to produce a SF/CC grade motor oil. The results of this evaluation are set forth in Table I. These results demonstrate that the reaction of the polyamine dispersants with maleic anhydride serves to passivate the dispersants toward the fluorohydrocarbon elastomer composition. In addition, the results also indicate that the amount of reduction in the total base number (TBN) of the dispersant is a measure of the extent of the passivation (see tests 8–11).

TABLE I

| Test | Dispersant | Oil | Test Period, Days | Elastomer Crazed |
|---|---|---|---|---|
| 1 | None | A | 3 | No |
| 2 | Mannich starting material of Example III | A | 3 | Yes |
| 3 | Product of Example III | A | 3 | No |
| 4 | Product of Example IV | A | 3 | No |
| 5 | Mannich starting material of Example III | B | 7 | Yes |
| 6 | Product of Example IV | B | 7 | No |
| 7 | None | B | 3 | No |
| 8 | Succinimide starting material of Example V | B | 3 | Yes |
| 9 | Product of Example V | B | 3 | No |
| 10 | Product of Example VI | B | 3 | No |
| 11 | Product of Example VII | B | 3 | No |

TABLE I-continued

| Test | Dispersant | % Change In Elastomer % Elongation | Tensile Strength |
|---|---|---|---|
| 1 | None | −9 | −19 |
| 2 | Mannich starting material of Example III | −39 | −35 |
| 3 | Product of Example III | −28 | +4 |
| 4 | Product of Example IV | −30 | +4 |
| 5 | Mannich starting material of Example III | −56 | −35 |
| 6 | Product of Example IV | −41 | −23 |
| 7 | None | −5 | −10 |
| 8 | Succinimide starting material of Example V | −46 | −32 |
| 9 | Product of Example V | −44 | −21 |
| 10 | Product of Example VI | −33 | −10 |
| 11 | Product of Example VII | −24 | +8 |

The foregoing discussion and examples are illustrative of the invention. However, since many embodiments of the invention can be made without departing from the spirit and intent of the invention, the invention is wholly contained within the claims hereinafter appended.

We claim:

1. A composition comprising the reaction product of a Mannich polyamine dispersant with maleic anhydride, said polyamine dispersant containing at least one primary or secondary amine and being effective as a dispersant additive for lubricating oils; and wherein the amount of maleic anhydride is effective to reduce the reactivity of said Mannich polyamine dispersant toward fluorohydrocarbon compositions.

2. The composition of claim 1 wherein the reaction of the Mannich polyamine dispersant and maleic anhydride is carried out at a temperature of about 20° to about 300° C.

3. The composition of claim 1 wherein the amount of maleic anhydride is effective to reduce the TBN of said Mannich polyamine dispersant by at least about 10 percent.

4. The composition of claim 3 wherein the amount of maleic anhydride is effective to reduce the TBN by at least about 50 percent.

5. A composition comprising the reaction product of a carboxylic polyamine dispersant with maleic anhydride, said dispersant containing at least one primary or secondary amine and being effective as a dispersant additive for lubricating oils; and wherein the amount of maleic anhydride is effective to reduce the reactivity of said carboxylic polyamine dispersant toward fluorocarbon compositions.

6. A lubricating oil composition comprising a major portion of a lubricating oil and from about 0.5 to about 15 weight percent of the composition of claim 1.

7. A lubricating oil composition comprising a major portion of a lubricating oil and from about 0.5 to about 15 weight percent of the composition of claim 5.

* * * * *